US008477129B2

(12) United States Patent
Hsueh et al.

(10) Patent No.: US 8,477,129 B2
(45) Date of Patent: Jul. 2, 2013

(54) SYSTEMS FOR DISPLAYING IMAGES

(75) Inventors: Fu-Yuan Hsueh, Bade (TW); Kai-Chieh Yang, Kaohsiung County (TW)

(73) Assignee: TPO Displays Corp., Miao-Li County (TW)

( * ) Notice: Subject to any disclaimer, the term of this patent is extended or adjusted under 35 U.S.C. 154(b) by 1288 days.

(21) Appl. No.: 12/255,872

(22) Filed: Oct. 22, 2008

(65) Prior Publication Data

US 2009/0122043 A1 May 14, 2009

(30) Foreign Application Priority Data

Nov. 12, 2007 (TW) ..... 96142677 A

(51) Int. Cl.
*G09G 5/00* (2006.01)

(52) U.S. Cl.
USPC ..... 345/210; 345/92; 345/98

(58) Field of Classification Search
USPC ..... 345/87, 85, 690
See application file for complete search history.

(56) References Cited

U.S. PATENT DOCUMENTS

| | | | | |
|---|---|---|---|---|
| 6,348,908 | B1 * | 2/2002 | Richley et al. | 345/85 |
| 7,417,610 | B2 * | 8/2008 | Abe et al. | 345/87 |
| 2005/0195145 | A1 | 9/2005 | Maki | |
| 2007/0040855 | A1 * | 2/2007 | Kato | 345/690 |

FOREIGN PATENT DOCUMENTS

| | | | |
|---|---|---|---|
| CN | 1574576 | A | 2/2005 |
| JP | 10260664 | A | 9/1998 |
| JP | 2002262547 | A | 9/2002 |

OTHER PUBLICATIONS

"High Efficiency Integrated Charge Pump Circuits or Poly-Si TFT-LCDs," Lin et. al., Advanced Technology Research Center, vol. 4, pp. 1085-1087.*

Japan Patent Office "Office Action", Sep. 25, 2012, Japan.

"High-Efficiency Integrated Charge Pump Circuits for Poly-Si TFT-LCDs," Lin et. al., Advanced Technology Research Center, vol. 4, pp. 1085-1087, May 2004.

"LTPS Circuit Integration for System-On-Glass LCDs," Lin et al., Journal of the SID, 2006, pp. 353-362.

"A Parallel Digital-Data-Driver Architecture for Low-Power Poly-Si TFT-LCDs," Haga et al., Digest, pp. 690-693, 2002.

* cited by examiner

*Primary Examiner* — Amare Mengistu
*Assistant Examiner* — Joseph G Rodriguez
(74) *Attorney, Agent, or Firm* — Morris Manning & Martin LLP; Tim Tingkang Xia, Esq.

(57) ABSTRACT

A system for displaying images is provided. The system comprises a reference voltage source, a digital-to-analog converter, a multiplier and a buffer. The reference voltage source outputs a voltage signal, wherein the magnitude of the voltage signal is 1/N of a driving voltage. The digital-to-analog converter converts the voltage signal to a first voltage. The multiplier receives and multiplies the first voltage by N to output the driving voltage. The buffer receives the driving voltage to drive a data line.

12 Claims, 10 Drawing Sheets

SYSTEMS FOR DISPLAYING IMAGES

CROSS REFERENCE TO RELATED APPLICATIONS

This Application claims priority of Taiwan Patent Application No. 096142677, filed on Nov. 12, 2007, the entirety of which is incorporated by reference herein.

BACKGROUND OF THE INVENTION

1. Field of the Invention

The present invention relates to a system for display images.

2. Description of the Related Art

Liquid crystal displays (LCDs) are used in a variety of applications including calculators, watches, color televisions, computer monitors, and many other electronic devices. An active matrix LCD is a well-known type of LCD. In a conventional active matrix LCD, each picture element (or pixel) comprises a thin film transistor (TFT) and one or more capacitors. The pixels are arranged and wired in an array having rows and columns.

To address a particular pixel, the proper row is switched "on" (i.e., charged with a voltage), and a voltage is sent down the correct column. Since the other rows that the column intersects are turned off, only the TFT and capacitor at the particular pixel receive a charge. In response to the applied voltage, the liquid crystal within the cell of the pixel changes its rotation and tilt angle, and thus, the amount of light is absorbed or passed therethrough.

Typically, the circuits that demand the most power consumption of the LCDs are the gate driving circuit and the data driving circuit. Meanwhile, with miniaturization of electronic devices, decreased the power consumption of LCDs has become a major factor for research and development; in efforts to continue and increase LCD applicability.

BRIEF SUMMARY OF THE INVENTION

An embodiment of the invention relates to a system for displaying images. The system comprises a reference voltage source, a digital-to-analog converter, a multiplier and a buffer. The reference voltage source outputs a voltage signal, wherein the magnitude of the voltage signal is 1/N of a driving voltage. The digital-to-analog converter converts the voltage signal to a first voltage. The multiplier receives and multiplies the first voltage by N to output the driving voltage. The buffer receives the driving voltage to drive a data line.

Another embodiment of the invention relates to a system for displaying images. The system comprises a pixel, a data driving unit, a multiplier, and a buffer. The data driving unit receives and outputs a display data, wherein the magnitude of the display data is 1/N of a driving voltage. The multiplier receives and multiplies the display data by N. The buffer receives the driving voltage to drive the pixel.

Another embodiment of the invention relates to a system for displaying images. The system comprises a display panel comprising a gate driving circuit, a data driving circuit, a multiplier and a pixel array. The gate driving circuit outputs a plurality of gate driving signals. The data driving circuit receives an image data to output a plurality of data driving signals, wherein the magnitude of the data driving signals is 1/N of a driving voltage. The multiplier receives and multiplies the data driving signals by N. The pixel array is controlled by the gate driving signals and the data driving signals to display a corresponding image.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
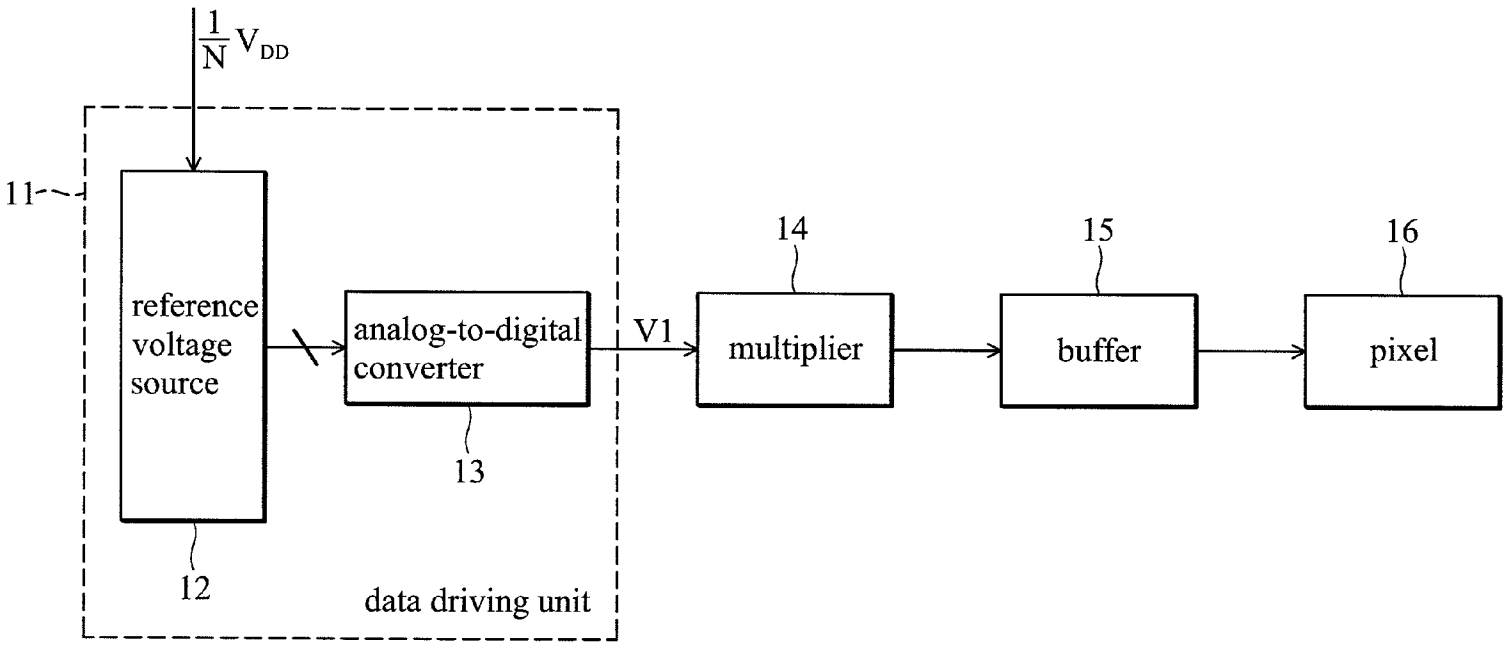
FIG. 1 is a schematic diagram of an embodiment of a data driving circuit according to the invention.

FIG. 1 is a schematic diagram of an embodiment of a data driving circuit according to the invention. In FIG. 1, the data driving unit 11 outputs an output voltage V1 to drive the pixel 16. The embodiment only illustrates the pixel 16, but does not limit the data driving unit thereto. The data driving unit may drive a plurality of pixels coupled to a data line or a plurality of sub-pixels of one pixel. The data driving unit 11 comprises a reference voltage source 12 and an analog-to-digital converter 13. The reference voltage source 12 receives voltage 1/N $V_{DD}$ to output voltage V1. The conventional reference voltage source receives voltage $V_{DD}$ and this causes more power consumption. The power consumption can be determined based on the equation: $P=V^2/R$. If the reference voltage source 12 receives voltage 1/N $V_{DD}$, the power consumption can be reduced to $1/N^2$ of the original power consumption. Since the output voltage of the reference voltage source 12 is low and may not normally drive the pixel 16, the multiplier 14 is required to receive and amplify the output voltage V1 of the data driving unit 11 by N to drive the pixel 16 via the buffer 15. Although the invention needs a multiplier 14 to amplify the voltage V1 and the multiplier 14 still consumes power, the power saved due to the voltage reference source 12 is more than the power consumption of the multiplier 14 and the overall power consumption is therefore reduced.

Figure 2:
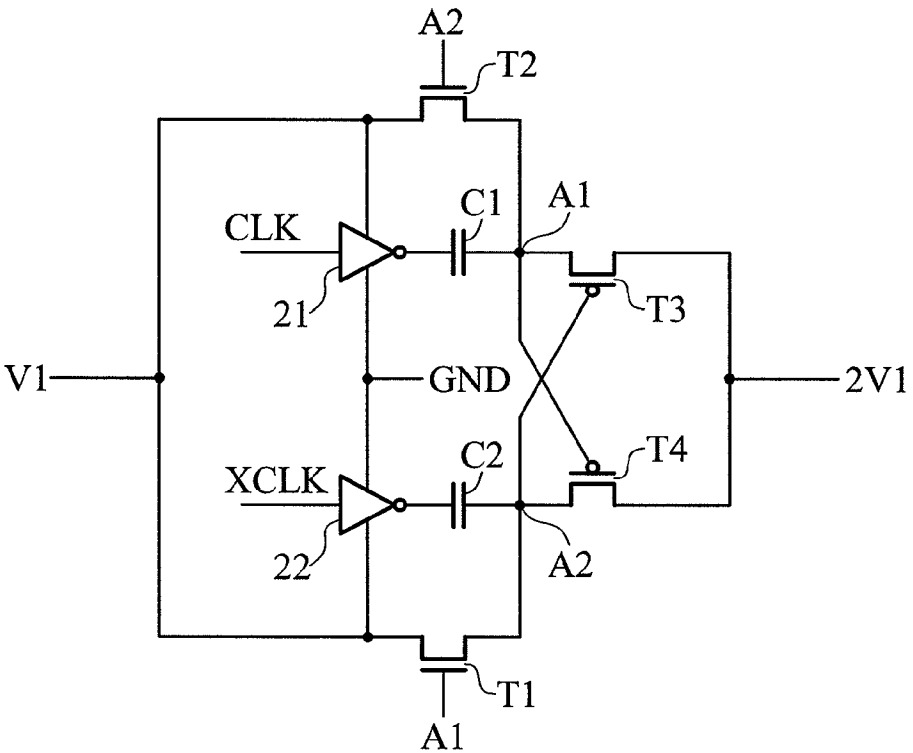
FIG. 2 is a circuit diagram of the multiplier according to an embodiment of the invention.

FIG. 2 is a circuit diagram of the multiplier according to an embodiment of the invention. In this embodiment, the multiplier is illustrated with a voltage-doubling circuit, but is not limited thereto. The transistor T1 comprises a first input terminal receiving a voltage V1, a first output terminal coupled to a node A2, and a first control terminal coupled to a node A1. The transistor T2 comprises a second input terminal receiving the voltage V1, a second output terminal coupled to the node A1, and a second control terminal coupled to the node A2. The transistor T3 comprises a third input terminal coupled to the node A1, a third output terminal for outputting voltage 2V1, and a third control terminal coupled to the node A2. The transistor T4 comprises a fourth input terminal coupled to the node A2, a fourth output terminal for outputting voltage 2V1, and a fourth control terminal coupled to the node A1. The inverter 21 receives a clock signal CLK and the capacitor C1 is coupled between the output terminal of the inverter 21 and the node A1. The inverter 22 receives an inverted clock signal XCLK and the capacitor C2 is coupled between the output terminal of the inverter 22 and the node A2. When the voltage of the output terminal of the inverter 21 changes from 0 to V1, the capacitor C1 is charged, the voltage of the node A1 rises from V1 to 2V1, and the voltage of the node A1 is outputted via the third output terminal of the transistor T3. Similarly, when the voltage of the output terminal of the inverter 22 changes from 0 to V1, the capacitor C2 is charged, the voltage of the node A2 rises from V1 to 2V1, and the voltage of the node A2 is outputted via the fourth output terminal of the transistor T4. In this embodiment, the clock signal XCLK is the inverted clock signal of the clock signal CLK, and the multiplier keeps on outputting voltage 2V1.

Figure 3:
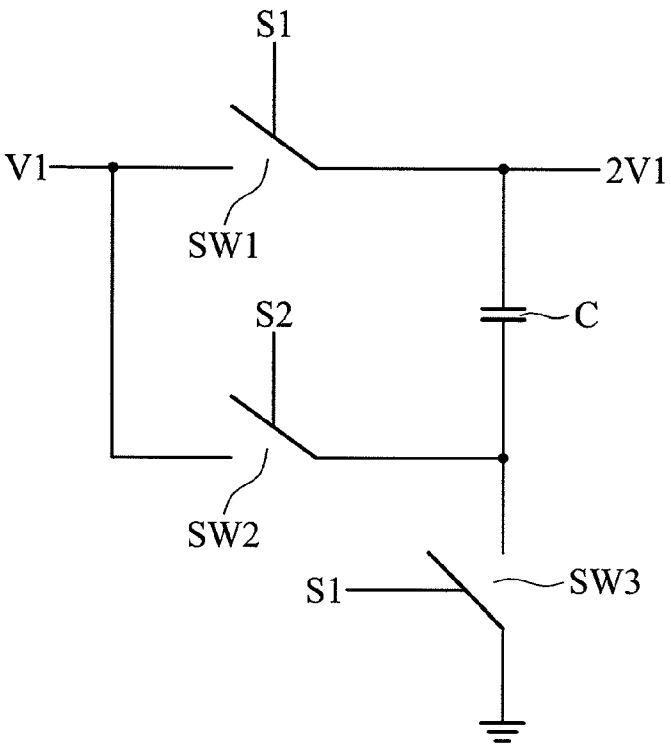
FIG. 3 is a circuit diagram of the multiplier according to another embodiment of the invention.

FIG. 3 is a circuit diagram of the multiplier according to another embodiment of the invention. The switch SW1 comprises an input terminal receiving voltage V1, a control terminal controlled by a control signal S1, and an output terminal for outputting voltage 2V1. The switch SW2 comprises an input terminal receiving voltage V1, a control terminal controlled by a control signal S2, and an output terminal, wherein the capacitor C is coupled between the output terminal of the switch SW1 and the output terminal of the switch SW2. The switch SW3 comprises an input terminal coupled to the output terminal of the switch SW2, a control terminal controlled by the control signal S1, and an output terminal grounded. In this embodiment. The control signal S1 is the inverted signal of the control signal S2, i.e. when the switches SW1 and SW3 are turned on, the switch SW2 is turned off. When the switches SW1 and SW3 are turned on, one terminal of the capacitor C is grounded, and the voltage V1 charges the capacitor C, thus, the voltage of the other terminal of the capacitor C, i.e. the output terminal of switch SW1, is V1. When the switches SW1 and SW3 are turned off, the voltage V1 charges the capacitor C via the switch SW2 and the voltage of the output terminal of switch SW1 therefore rises to 2V1. According to the described method, the multiplier can output a doubling-voltage. Although the multiplier of the embodiments outputs a doubling-voltage, it is not limited thereto. Furthermore, the described switches may be NMOS transistors, PMOS transistors, CMOS transistors or transmission gates.

Figure 4:
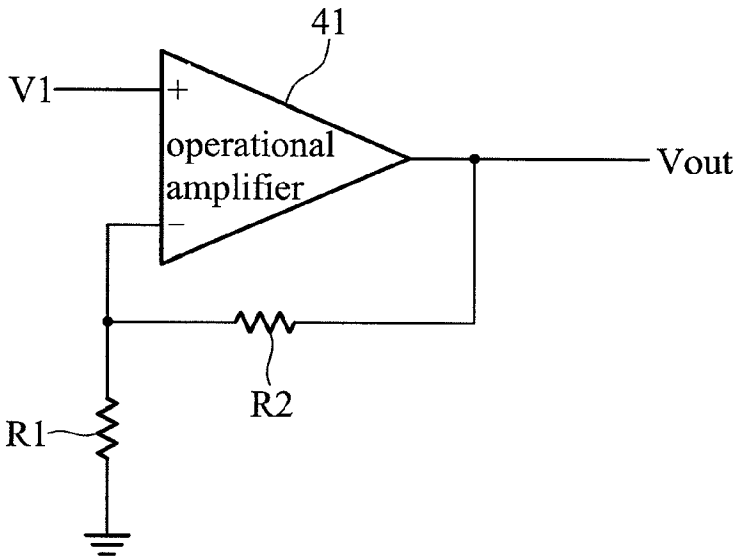
FIG. 4 is a circuit diagram of another embodiment of the multiplier according to the invention.

FIG. 4 is a circuit diagram of another embodiment of the multiplier according to the invention. The operational amplifier 41 comprises a positive input terminal receiving voltage V1, a negative input terminal, and an output terminal to output voltage Vout. The negative input terminal of the operational amplifier 41 is coupled between the resistors R1 and R2, and another terminal of resistor R1 is grounded, and another terminal of resistor R2 is coupled to the output terminal of the operational amplifier 41. In this embodiment, the relation between the output voltage Vout and the voltage V1 can be shown as:

$$Vout=V1(1+R2/R1).$$

Therefore, the magnitude of the output voltage Vout can be adjusted by adjusting the ratio of R2 to R1, i.e., the multiplication factor can be adjusted by adjusting the resistance of resistors R1 and R2.

Figure 5:
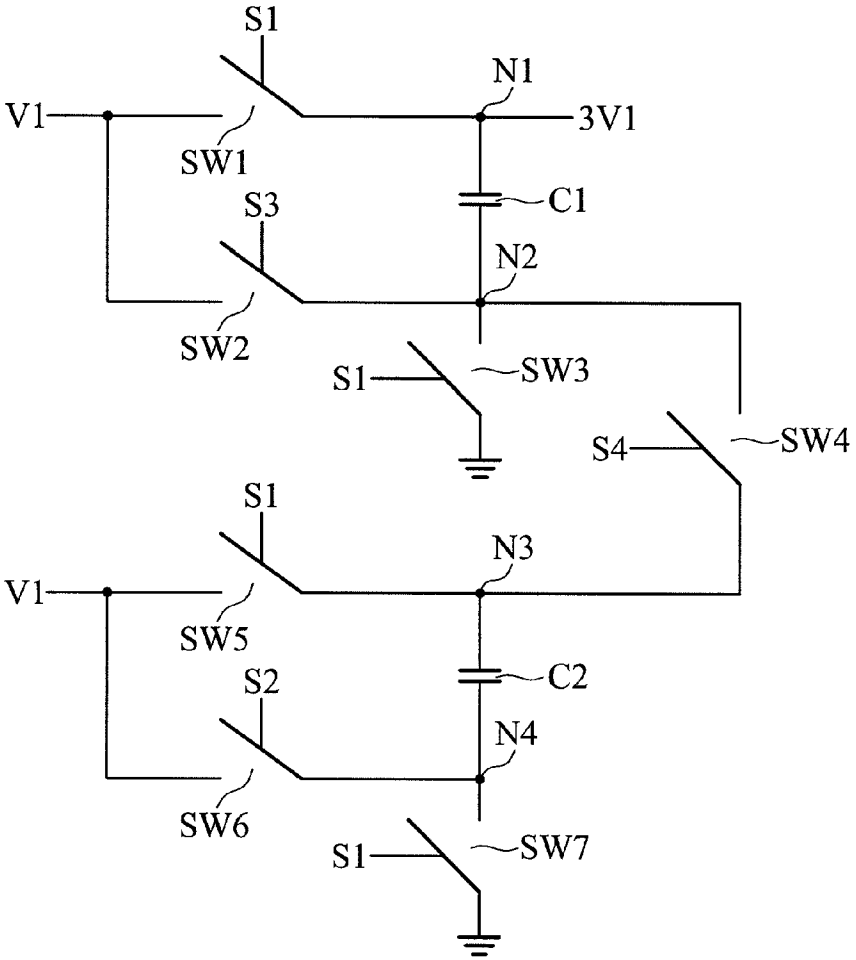
FIG. 5 is a circuit diagram of another embodiment of the multiplier according to the invention.

FIG. 5 is a circuit diagram of another embodiment of the multiplier according to the invention. In this embodiment, the multiplier multiplies the input voltage by 3. The switch SW1 comprises an input terminal receiving a voltage V1, a control terminal controlled by a control signal S1, and an output terminal to output a voltage 3V1. The switch SW2 comprises an input terminal receiving the voltage V1, a control terminal controlled by a control signal S3, and an output terminal, wherein the capacitor C1 is coupled between the output terminal of the switch SW1 and the output terminal of the switch SW2. The switch SW3 comprises an input terminal coupled to the output terminal of the switch SW2, a control terminal controlled by the control signal S1, and an output terminal grounded. The switch SW5 comprises an input terminal receiving the voltage V1, a control terminal controlled by the control signal S1, and an output terminal. The switch SW6 comprises an input terminal receiving the voltage V1, a control terminal controlled by the control signal S2, and an output terminal, wherein the capacitor C2 is coupled between the output terminal of the switch SW5 and the output terminal of the switch SW6. The switch SW7 comprises an input terminal coupled to the output terminal of the switch SW6, a control terminal controlled by the control signal S1, and an output terminal grounded. The switch SW4 comprises an input terminal coupled to the output terminal of the switch SW5, an output terminal coupled the output terminal of the switch SW2, and a control terminal controlled by a control signal S4. In this embodiment, the voltage V1 charges the capacitor C1 and the voltage of the output terminal of the switch SW1 therefore becomes V1. The voltage V1 also charges the capacitor C2, and the voltage of the output terminal of the switch SW5 therefore becomes V1. After the switch SW5 is turned off, the switch SW6 is turned on, and the voltage V1 charges the capacitor C2 via switch SW6, and the voltage of the output terminal of the switch SW5 therefore becomes 2V1. Then, the switch SW4 is turned on, the voltage of the output terminal of the switch SW5 charges the capacitor C1, and the voltage of the output terminal of the switch SW1 becomes 3V1. Furthermore, the described switches may be NMOS transistors, PMOS transistors, CMOS transistors or transmission gates.

Figure 6:
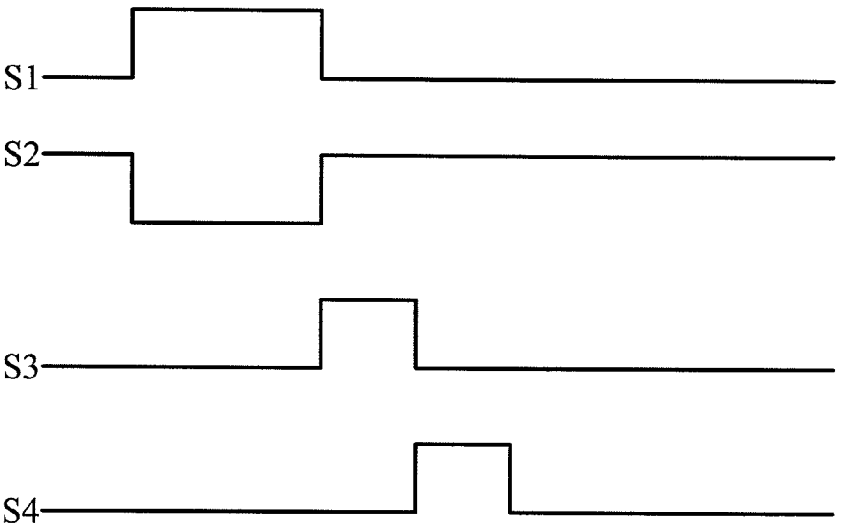
FIG. 6 is a timing diagram of the multiplier of FIG. 5.

For further illustration, please refer to FIG. 6. FIG. 6 is a timing diagram of the multiplier of FIG. 5. When the control signal S1 is at high voltage level, the switches SW1, SW3, SW5 and SW7 are turned on, and the voltage of the nodes N1 and N3 is V1. At this time, the control signal S2 is at low voltage level, and the switch SW6 is turned off. When the control signal S3 is at high voltage level, the switch SW2 is turned on, the voltage V1 therefore charges the capacitor C1 via the node N2, and the voltage of the node N1 becomes 2V1. At this time, the control signal S2 is also at high voltage level, the switch SW6 is turned on and the voltage V1 charges the capacitor C2 via the node N4 to increase the voltage of the node N3 to 2V1. When the control signal S4 is at high voltage level, the voltage of the node N2 rises from V1 to 2V1 and the voltage of the node N1 also increases to 3V1. According to this method, the multiplier can multiply the input voltage by 3.

Figure 7:
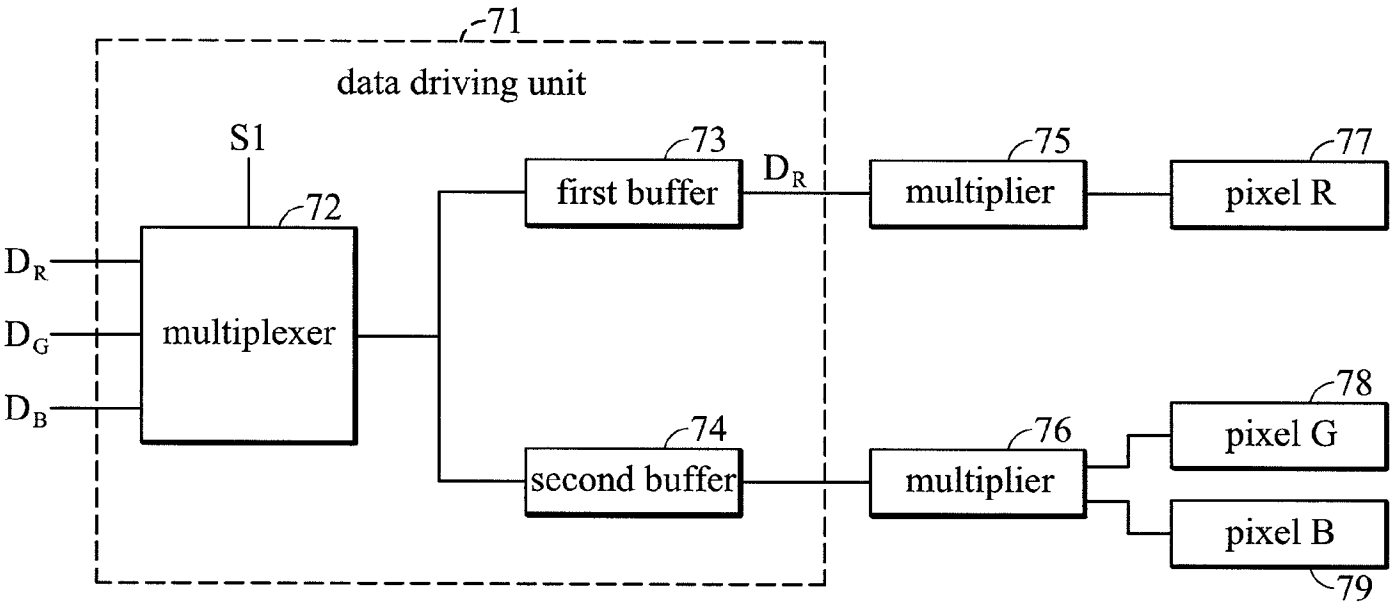
FIG. 7 is a schematic diagram of another embodiment of the data driving circuit according to the invention.

FIG. 7 is a schematic diagram of another embodiment of the data driving circuit according to the invention. The data driving unit 71 receives the display data $D_R$, $D_G$ and $D_B$ to drive the corresponding pixel R 77, pixel G 78, and pixel B 79. The data driving unit 71 comprises a multiplexer 72, controlled by a control signal S1, receiving and displaying the display data $D_R$, $D_G$ and $D_B$ according a time division multiplexing mechanism. The first buffer 73 receives and outputs the display data $D_R$ to the multiplier 75 and the second buffer 74 receives and outputs the display data $D_G$ and $D_B$ to the multiplier 76. In this embodiment, the second buffer 74 sequentially outputs the display data $D_G$ and $D_B$ according to a sample/latch mechanism. In this embodiment, the magnitude of the voltage of the display data is 1/N of a predetermined value. Therefore, the multipliers 75 and 76 amplify the voltage of the display data to normally drive the corresponding pixel R 77, pixel G 78, and pixel B 79. In one embodiment, the data driving unit 71 further comprises an analog-to-digital converter (not shown in FIG. 7) to convert the display data to a first voltage, and the multipliers 75 and 76 amplify the voltage of the display data to normally drive the corresponding pixel R 77, pixel G 78, and pixel B 79. The details of the multipliers 75 and 76 have been described in the description of FIG. 2 to FIG. 5, and will not be illustrated here for brevity.

Figure 8:
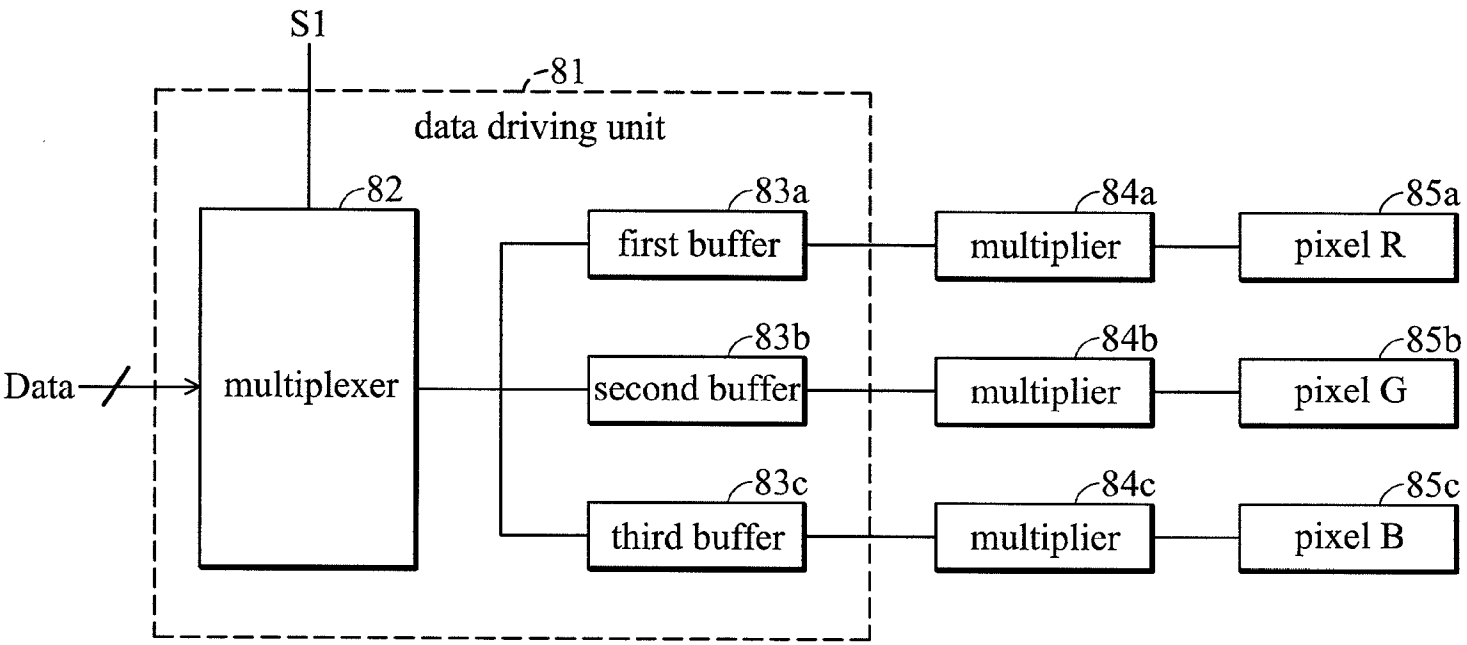
FIG. 8 is a schematic diagram of another embodiment of the data driving circuit according to the invention.

FIG. 8 is a schematic diagram of another embodiment of the data driving circuit according to the invention. The data driving unit 81 receives the display data and the display data is respectively amplified by the multiplier 84*a*, 84*b* and 84*c* to drive the corresponding pixel R 85*a*, pixel G 85*b*, and pixel B 85*c*. In this embodiment, the display data is a stream data, and comprises display data $D_R$, $D_G$ and $D_B$. The multiplexer 82 receives the display data and outputs the display data $D_R$, $D_G$ and $D_B$ at different time periods to the corresponding buffers 84*a*, 84*b* and 84*c* according to a time division multiplexing mechanism.

In this embodiment, the magnitude of the voltage of the display data is 1/N of a predetermined value. Therefore, the multipliers 84*a*, 84*b* and 84*c* amplify the voltage of the display data to normally drive the corresponding pixel R 85*a*, pixel G 85*b*, and pixel B 85*c*. The display data can comprise gamma correction data. The details of the multipliers 84*a*, 84*b* and 84*c* have been described in the description of FIG. 2 to FIG. 5, and will not be illustrated here for brevity.

Figure 9:
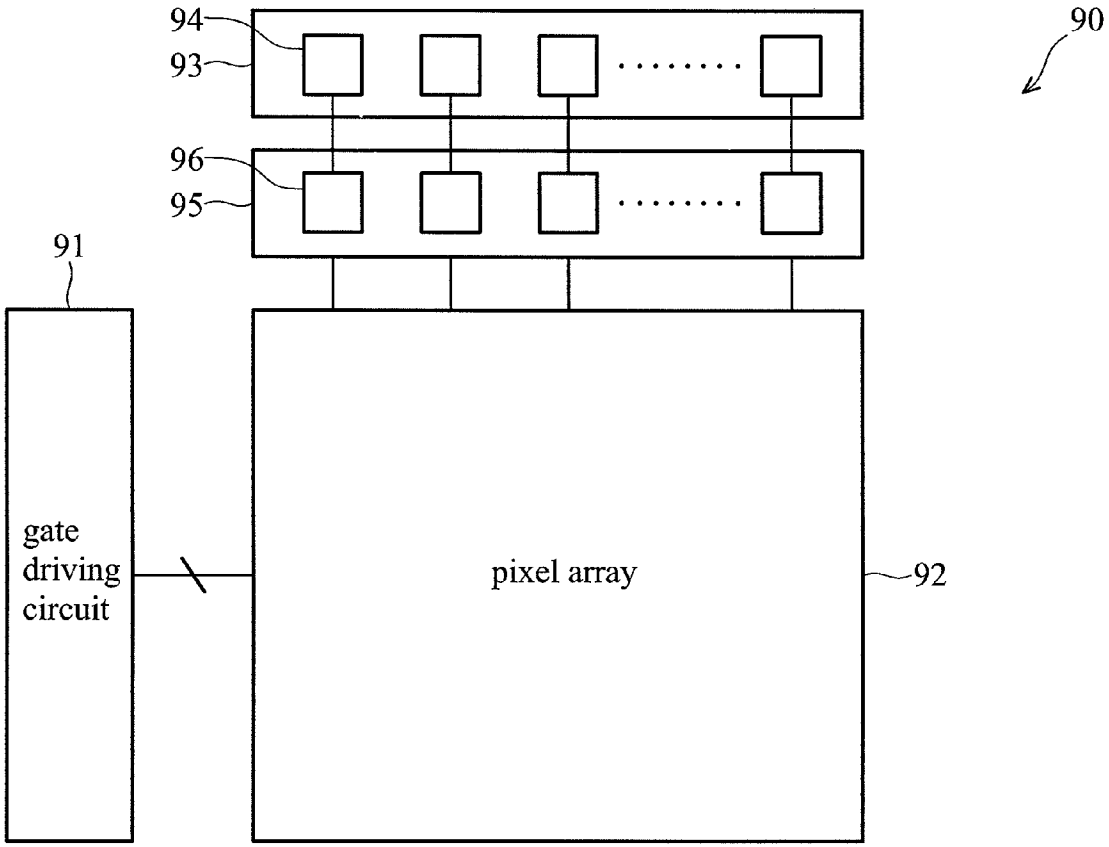
FIG. 9 is a schematic diagram of an embodiment of a display panel according to the invention.

FIG. 9 is a schematic of an embodiment of a display panel according to the invention. The display panel 90 comprises a gate driving circuit 91, a data driving circuit 93, a multiplier 95 and a pixel array 92. The pixel array 92 is driven by the output signals of the gate driving circuit 91 and data driving circuit 93 to display a corresponding image. The data driving circuit 93 comprises a plurality of data driving units, such as the data driving unit 94. The multiplier 95 comprises a plurality of multiplying units, such as the multiplying unit 96. In this embodiment, the output signal of each data driving unit is amplified by a corresponding multiplying unit, and then is transmitted to the pixel array 92. In another embodiment, the output signals of the data driving units of the data driving circuit 93 can be amplified by only one multiplying unit, and the amplified signal is transmitted to the corresponding data line via a multiplexer (not shown in FIG. 9).

Figure 10:
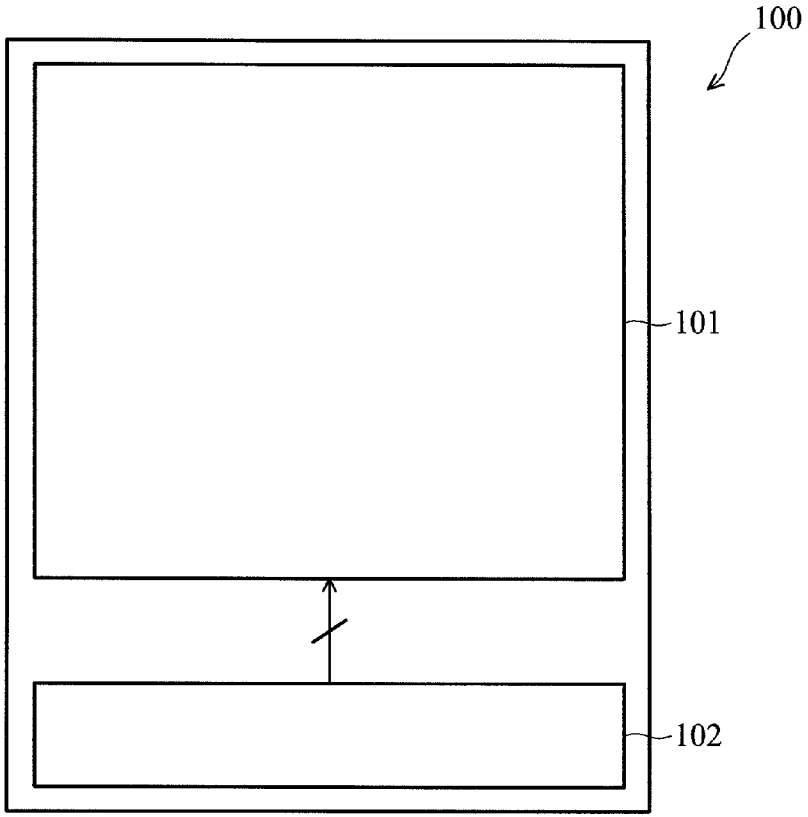
FIG. 10 is a schematic diagram of an embodiment of an image display system according to the invention.

FIG. 10 is a schematic diagram of an embodiment of an image display system according to the invention. In this embodiment, the image display system may be implemented by the display panel 101 or an electronic device 100. The electronic device 100 comprises an input device 102 and the display panel 101, such as the panel 90 in FIG. 9. The input device 102 provides input signals to the display panel 101 and the display panel 101 displays the corresponding image. In one preferred embodiment, the electronic device 100 is a cell phone, a digital camera, a personal digital assistant, a laptop, a personal computer, a television, a car display, a global positioning system, a flight display, a digital photo frame or a portable DVD player.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images, comprising:

a reference voltage source outputting a voltage signal, wherein the magnitude of the voltage signal is 1/N of a driving voltage;

a digital-to-analog converter converting the voltage signal to a first voltage;

a multiplier receiving and multiplying the first voltage by N to output the driving voltage; and a buffer receiving the driving voltage to drive a data line, wherein the multiplier further comprises:

a first capacitor comprising a first terminal and a second terminal;

a first switch comprising a first input terminal receiving the first voltage, a first output terminal coupled to the first terminal of the first capacitor, and a first control terminal controlled by a first control signal;

a second switch comprising a second input terminal receiving the first voltage, a second output terminal coupled to the second terminal of the first capacitor, and a second control terminal controlled by a second control signal;

a third switch comprising a third input terminal coupled to the second output terminal, a third output terminal grounded, and a third control terminal controlled by the first control signal;

a fourth switch comprising a fourth input terminal, a fourth output terminal coupled to the third input terminal, and a fourth control terminal controlled by a third control signal; and a voltage-doubling circuit comprising an input terminal receiving the first voltage and an output terminal coupled to the fourth input terminal and outputting a second voltage, wherein when the fourth switch is turned on, the multiplier output a sum of the first voltage and the second voltage.

2. The system as claimed in claim 1, wherein the voltage-doubling circuit comprises:

a second capacitor comprising a first terminal and a second terminal;

a fifth switch comprising a fifth input terminal receiving the first voltage, a fifth output terminal coupled to the first terminal of the second capacitor, and a fifth control terminal controlled by the first control signal;

a sixth switch comprising a sixth input terminal receiving the first voltage, a sixth output terminal coupled to the second terminal of the second capacitor, and a six control terminal controlled by a fourth control signal; and a seventh switch comprising a seventh input terminal coupled to the sixth output terminal, a seventh output terminal grounded, and a seventh control terminal controlled by the first control signal.

3. A system for displaying images, comprising:

a pixel;

a data driving unit receiving and outputting a display data, wherein the magnitude of the display data is 1/N of a driving voltage;

a multiplier receiving and multiplying the display data by N; and a buffer to receive the driving voltage to drive the pixel, wherein the display data comprises a first display data, a second display data and a third display data, and the data driving unit further comprises:

a first buffer;

a second buffer; and a multiplexer, controlled by a first control signal, receiving the first display data, the second display data and the third display data, outputting the first display data to the first buffer and outputting the second display data and the third display data to the second buffer based on the first control signal.

4. The system as claimed in claim 3, wherein the data driving unit further comprises a digital-to-analog converter to receive and convert the display data to a first voltage signal.

5. The system as claimed in claim 3, wherein the display data further comprises gamma correction data.

6. The system as claimed in claim 3, wherein the multiplier further comprises:

a first capacitor comprising a first terminal and a second terminal a first switch comprising a first input terminal, a first output terminal, and a first control terminal, wherein the first input terminal receives the first voltage, the first control terminal is controlled by a first control signal and the first output terminal is coupled to the first terminal of the first capacitor;

a second switch comprising a second input terminal, a second output terminal, and a second control terminal, wherein the second input terminal receives the first voltage, the second control terminal is controlled by a second control signal and the second output terminal is coupled to the second terminal of the first capacitor; and a third switch comprising a third input terminal, a third output terminal, and a third control terminal, wherein the third input terminal is coupled to the second output terminal, the third control terminal is controlled by the first control signal and the third output terminal is grounded.

7. The system as claimed in claim 3, wherein the multiplier further comprises:

an operational amplifier comprising a positive input terminal, a negative input terminal and an output terminal, wherein the positive input terminal receives the first voltage;

a first resistor comprising a first terminal coupled to the negative input terminal and a grounded second terminal; and a second resistor comprising a first terminal coupled to the negative input terminal and a second terminal coupled to the output terminal of the operational amplifier.

8. The system as claimed in claim 3, wherein the multiplier comprises a first multiplier coupled to the first buffer, and a second multiplier coupled to the second buffer.

9. The system as claimed in claim 3, wherein the second display data and the third display data are transmitted to the second buffer according to a time division multiplexing mechanism.

10. The system as claimed in claim 8, wherein the pixel comprises a first sub-pixel coupled to the first multiplier, a second sub-pixel and a third sub-pixel coupled to the second multiplier.

11. A system for displaying images, comprising:

a display panel, comprising:

a gate driving circuit outputting a plurality of gate driving signals;

a data driving circuit receiving an image data and outputting a plurality of data driving signals, wherein the magnitude of the data driving signals is 1/N of a driving voltage;

a multiplier receiving and multiplying the data driving signals by N; and a pixel array controlled by the gate driving signals and the data driving signals to display a corresponding image, wherein the multiplier further comprises:

a first capacitor comprising a first terminal and a second terminal;

a first switch comprising a first input terminal receiving the first voltage, a first output terminal coupled to the first terminal of the first capacitor, and a first control terminal controlled by a first control signal;

a second switch comprising a second input terminal receiving the first voltage, a second output terminal coupled to the second terminal of the first capacitor, and a second control terminal controlled by a second control signal;

a third switch comprising a third input terminal coupled to the second output terminal, a third output terminal grounded, and a third control terminal controlled by the first control signal;

a fourth switch comprising a fourth input terminal, a fourth output terminal coupled to the third input terminal, and a fourth control terminal controlled by a third control signal; and a voltage-doubling circuit comprising an input terminal receiving the first voltage and an output terminal coupled to the fourth input terminal and outputting a second voltage, wherein when the fourth switch is turned on, the multiplier output a sum of the first voltage and the second voltage.

12. The system as claimed in claim 11, further comprising an electronic device, wherein the electronic device comprises:

the claimed display panel; and an input device to control the display panel to display the corresponding image.

* * * * *